US005557292A

United States Patent [19]

Nygren et al.

[11] Patent Number: 5,557,292

[45] Date of Patent: Sep. 17, 1996

[54] MULTIPLE BAND FOLDING ANTENNA

[75] Inventors: Evert C. Nygren, Los Altos; Peter W. Lord, Mountainview; Vito J. Jakstys, Penn Valley; Sina Barkeshli, Saratoga; Levent Ersoy, Cupertino, all of Calif.

[73] Assignee: Space Systems/Loral, Inc., Palo Alto, Calif.

[21] Appl. No.: 263,558

[22] Filed: Jun. 22, 1994

[51] Int. Cl.[6] ..... H01Q 19/14

[52] U.S. Cl. ..... 343/781 P; 343/753; 343/909; 343/DIG. 2

[58] Field of Search ..... 343/781 P, 781 CA, 343/DIG. 2, 753, 754, 755, 909, 786, 895, 756, 781 R; H01Q 19/14

[56] References Cited

U.S. PATENT DOCUMENTS

| | | | |
|---|---|---|---|
| 3,395,059 | 7/1968 | Butler et al. | 343/786 |
| 4,387,377 | 6/1983 | Kandler | 343/786 |
| 4,562,441 | 12/1985 | Beretta et al. | 343/781 P |
| 5,086,304 | 2/1992 | Collins | 343/786 |
| 5,258,771 | 11/1993 | Praba | 343/895 |
| 5,373,302 | 12/1994 | Wu | 343/909 |

OTHER PUBLICATIONS

J. Huang et al., "Tri-Band Frequency Selective Surface With Circular Ring Elements", 91CH3036-1/0000-0204 $1.00, 1991 IEEE, pp. 204-207.

*Primary Examiner*—Hoanganh Le
*Attorney, Agent, or Firm*—Perman & Green

[57] ABSTRACT

An antenna has one feed for an S-band electromagnetic signal, and a second feed constructed as an array of radiators to service two C-band signal channels. A subreflector having a microwave frequency selective surface (FSS) is placed in front of a main reflector. The C-band feed is constructed of an array of square aperture horns joined by separate transmit and receive barline beam-forming networks, and a meanderline polarizer to produce circularly polarized radiation patterns. Tapered ridges extend longitudinally along inner wall surfaces of each of the horns to provide increased bandwidth to the C-band feed. The frequency selective surface is constructed, typically, of a generally planar substrate of material transparent to electromagnetic radiation, and numerous metallic, generally annular, radiating elements, or resonators, arranged on the substrate in an array of repeating nested sets of the radiating elements. The lower frequency S-band feed is located behind and to the side of the subreflector for transmission of radiation via a folded optical path to the main reflector. The C-band feed is located in front of and to the side of the subreflector for transmission of radiation along a straight path through the FSS to the main reflector. The locating of the two feeds to the side of the subreflector permits the subreflector to be stowed by folding down upon the C-band feed, and the main reflector to be stowed by folding down upon both the S-band feed and the stowed subreflector.

7 Claims, 13 Drawing Sheets

VERTICAL
CROSS SECTION

MULTIPLE BAND FOLDING ANTENNA

BACKGROUND OF THE INVENTION

This invention relates to an array antenna which is constructed for stowing on board a satellite by use of hinged antenna elements and, more particularly, to an array antenna having a main reflector and a subreflector, the subreflector comprising a frequency selective surface (FSS) allowing concurrent operation at the S band portion of the electromagnetic spectrum by reflection from the subreflector to the main reflector and at C band by transmission through the subreflector, the C band employing a common feed for two signal channels at different frequencies.

The use of satellite communication systems imposes increasing burdens in the amount of electronic equipment to be carried by a satellite to accommodate numerous electromagnetic signal transmission channels, both up-link from the earth to the satellite and down-link to the earth from the satellite. For example, in a situation of interest herein, there is a requirement for provision of an S-band signal channel and two C-band signal channels wherein one of the C-band channels is employed for transmission by the satellite and the other C-band channel is employed for reception by the satellite.

A problem arises in that, in order to provide for the foregoing single S-band and two C-band channels, current satellite communication technology employs a plurality of antennas to accommodate the three channels. This is undesirable in that the plural antennas occupy additional space on the satellite and add additional weight to the satellite resulting in increased complexity for stowage and deployment and increased cost in launching the satellite.

SUMMARY OF THE INVENTION

The aforementioned problems are overcome and other advantages are provided by a construction of an antenna, in accordance with the invention, wherein a single S-band feed is employed for transmission and/or reception of an S-band signal, and a separate single C-band feed constructed as an array of radiators is employed for both of the foregoing C-band signal channels. A common main reflector is operative with both of the feeds. In addition, the antenna includes a subreflector having a microwave frequency selective surface by which the feeds communicate with the main reflector. In the C-band feed, the radiators are square aperture horns joined by separate transmit and receive barline beamforming networks, and a meanderline polarizer extends across radiating aperture of the radiators to produce circularly polarized radiation patterns. Tapered ridges extend longitudinally along inner wall surfaces of each of the horns to provide increased bandwidth to the C-band feed.

The frequency selective surface is constructed, typically, of a generally planar substrate of material transparent to electromagnetic radiation, and numerous radiating elements, or resonators, disposed on the substrate. The radiating elements are arranged in an array of repeating nested sets of radiating elements, each of which is configured as a closed path, such as an annulus, of electrically conductive material. In a preferred embodiment of the invention, each nested set of the radiating elements includes three radiating elements, namely, a relatively small inner element, a larger middle element encircling the inner element, and an outer element of still larger size encircling the middle element. Preferably, the outer element is configured as a hexagon, rather than a circular annulus, to permit a closer spacing of the nested sets of radiating elements, thereby to increase the available beam width of the antenna without introduction of grating lobes. The subreflector, by virtue of its construction with the FSS, is formed as a relatively thin antenna element which is readily stowed by folding down against a housing of the satellite.

The main reflector is substantially larger than the subreflector, and is disposed behind the subreflector. The lower frequency S-band feed is located behind and to the side of the subreflector for transmission of radiation via a folded optical path to the main reflector, wherein the radiation reflects from the FSS. The C-band feed is located in front of and to the side of the subreflector for transmission of radiation along a straight path through the FSS to the main reflector. Both of the reflectors are positioned by hinged supports. The locating of the two feeds to the side of the subreflector permits the subreflector to be stowed by folding down upon the C-band feed, and the main reflector to be stowed by folding down upon both the S-band feed and the stowed subreflector. Thereby, the invention enables a single antenna to accommodate all three of the foregoing channels while being capable of stowage on board a satellite.

BRIEF DESCRIPTION OF THE DRAWING

The aforementioned aspects and other features of the invention are explained in the following description, taken in connection with the accompanying drawing figures wherein.

Figure 1:
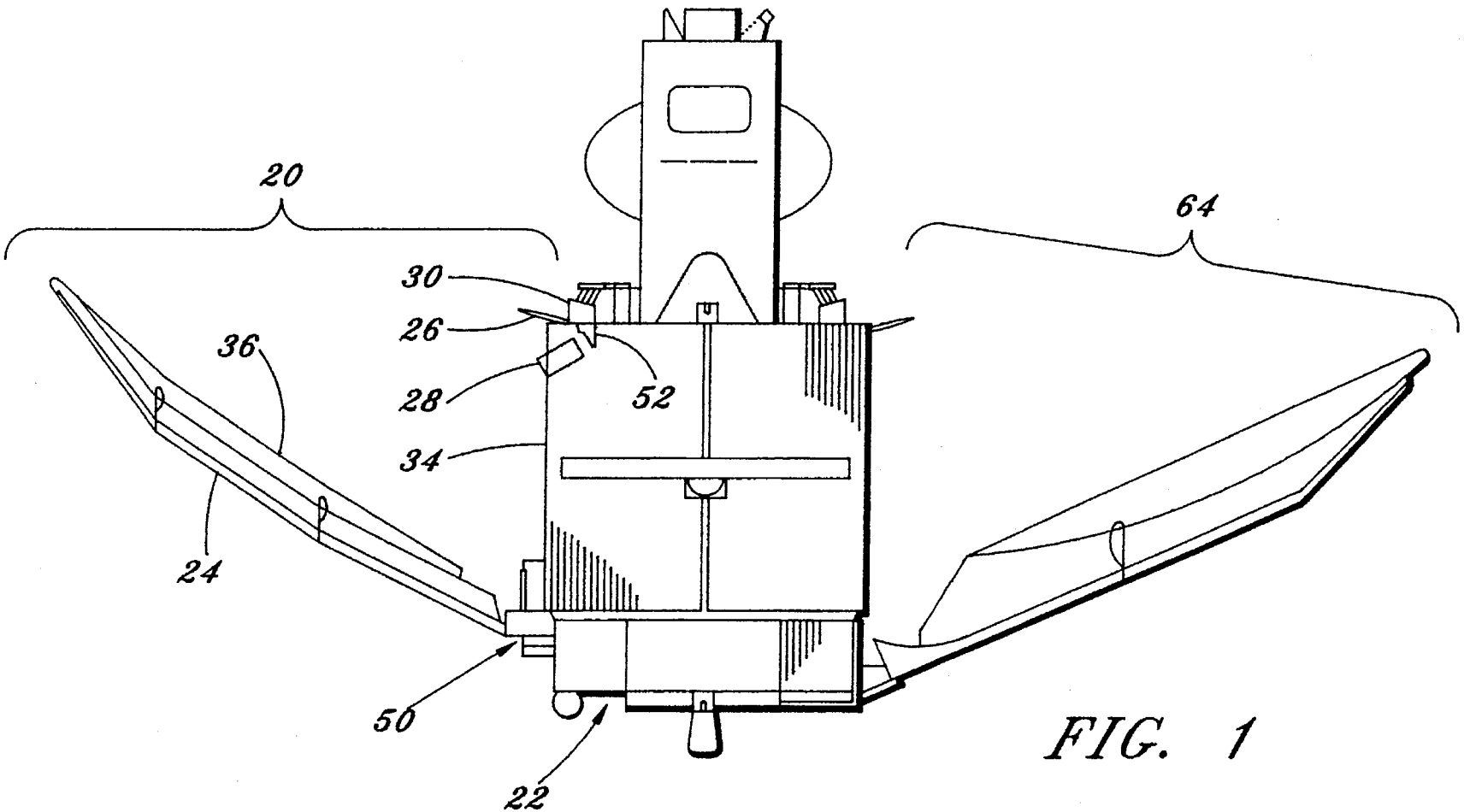
FIG. 1 shows a stylized view of a satellite carrying antennas constructed in accordance with the invention, with the antennas being deployed.

Identically labeled elements appearing in different ones of the figures refer to the same element in the different figures.

DETAILED DESCRIPTION

FIGS. 1–4 show construction of the antenna 20 of the invention, and the manner in which the antenna 20 can be deployed on board a communications satellite 22 (FIG. 1) and stowed on the satellite 22 within a launch vehicle's shroud 22A (FIG. 2) prior to launch. The antenna 20 is operative to transmit and receive microwave radiation to and from ground stations on the earth, and comprises a main reflector 24, a subreflector 26, an S-band feed 28, and a C-band feed 30. The subreflector 26 has a frequency selective surface (FSS) 32 which is operative to reflect the relatively low frequency S-band radiation of the S-band feed 28, and is operative in a transparent mode to transmit the relatively high frequency C-band radiation of the C-band feed 30. In the arrangement of the antenna components in the deployed configuration of the antenna 20, the subreflector 26 is positioned in front of the main reflector 24, the S-band feed 28 is located behind and to the side of the subreflector 26, and the C-band feed 30 is located forward and to the side of the subreflector 26. This arrangement of the antenna components allows the components to be mounted conveniently upon a housing 34 of the satellite 22. Furthermore, this arrangement of the antenna components allows radiation from the S-band feed 28 to be reflected by the FSS 32 to the main reflector 24, while allowing concurrently radiation from the C-band feed 30 to propagate along a linear optical path through the FSS 32 directly to the main reflector 24. The main reflector 24 has a curved reflecting surface 36 which is operative in conjunction with radiators (to be described hereinafter) of the feeds 28 and 30 to form beams of radiation at the S-band and the C-band band frequencies.

In accordance with a feature or the invention, the antenna 20 is operative with one S-band signal channel in one portion of the electromagnetic spectrum, and with two C-band signal channels in two separate portions of the spectrum. The S-band signal channel is in the frequency band of 2.655–2.690 GHz (gigahertz), this band being reflected by the FSS 32. One of the C-band channels is in the frequency band of 3.7–4.2 GHz, this band being passed by the FSS 32 and serving as a transmit signal channel for transmission of signals from the C-band feed 30. The second of the C-band channels is in the frequency band of 5.925–6.425 GHz, this band being passed by the FSS 32 and serving as a receive signal channel for reception of signals by the C-band feed 30.

Figure 4:
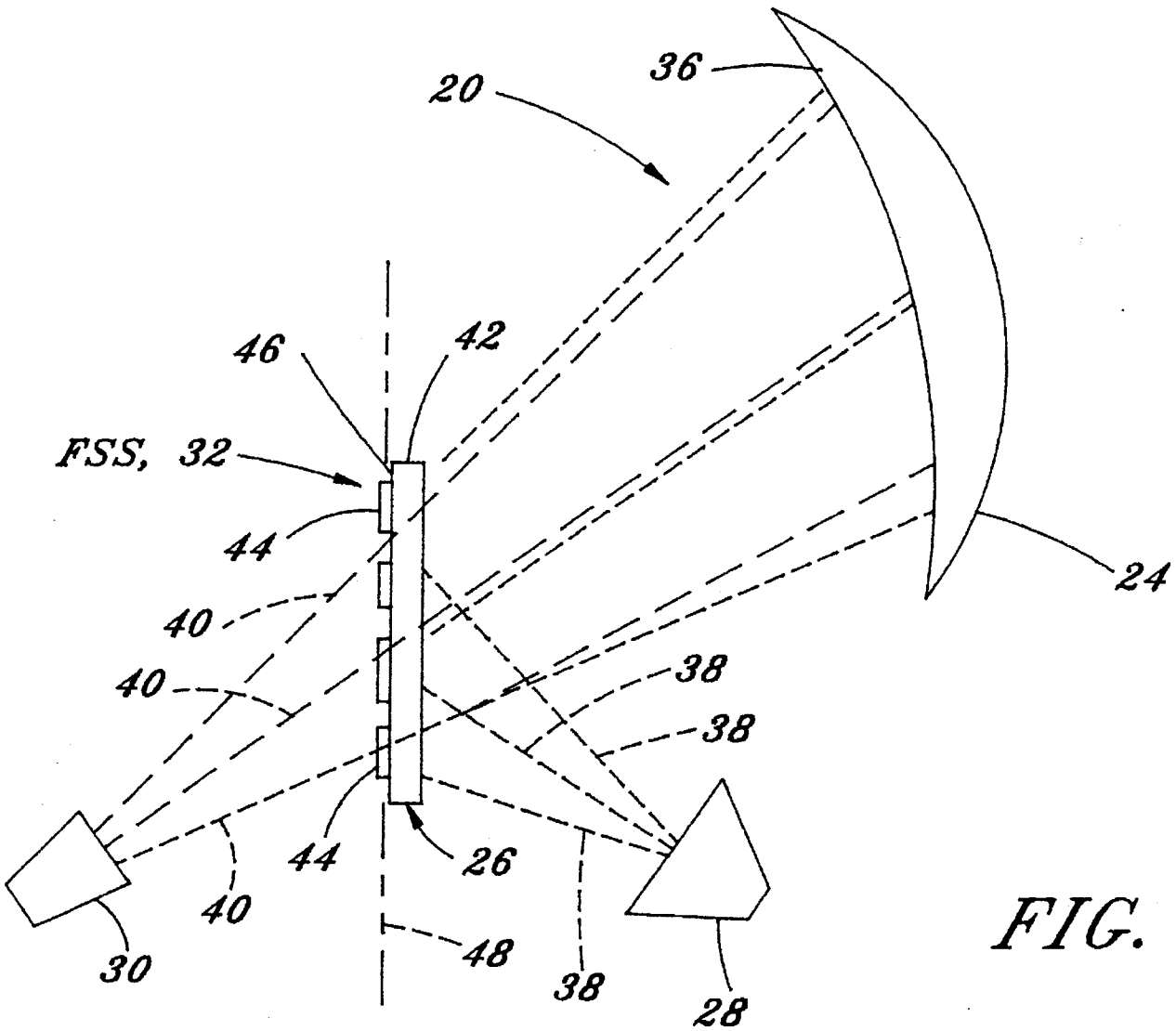
FIG. 4 is a simplified side view of the antenna with rays of radiation to demonstrate operation of the FSS.

FIG. 4 demonstrates the propagation paths of rays of radiation, in the deployed configuration of the antenna 20, between the feeds 28, 30 and the main reflector 24. Rays 38 of S-band radiation, indicated by short dashes, propagate along optical paths which are folded at the FSS 32, the optical paths of the rays 38 extending from the S-band feed 28 via the FSS 32 of the subreflector 26 to the reflecting surface 36 of the main reflector 24. Rays 40 of C-band radiation, indicated by long dashes, propagate along the aforementioned straight optical paths from the C-band feed 30 through the FSS 32 to the reflecting surface 36 of the main reflector 24. The C-band feed 30 lies at the focus of the reflecting surface 36 of the main reflector 24. The subreflector 26 has a substrate 42 for supporting the FSS 32, the substrate 42 being transparent to the C/S band radiations. The FSS 32 comprises an array of resonators or radiating elements 44 disposed on a front surface 46 of the substrate 42. The front surface 46 lies within a plane 48 which is equidistant and symmetrically positioned between the feeds 28 and 30. This provides for a geometrical arrangement of the antenna components such that the S-band rays 38, if traced back from the main reflector 24 through the FSS, would converge upon the location of the C-band feed 30. Thus, the S-band feed 28 is located at a reflected virtual focal point of the main reflector 24.

Figure 2:
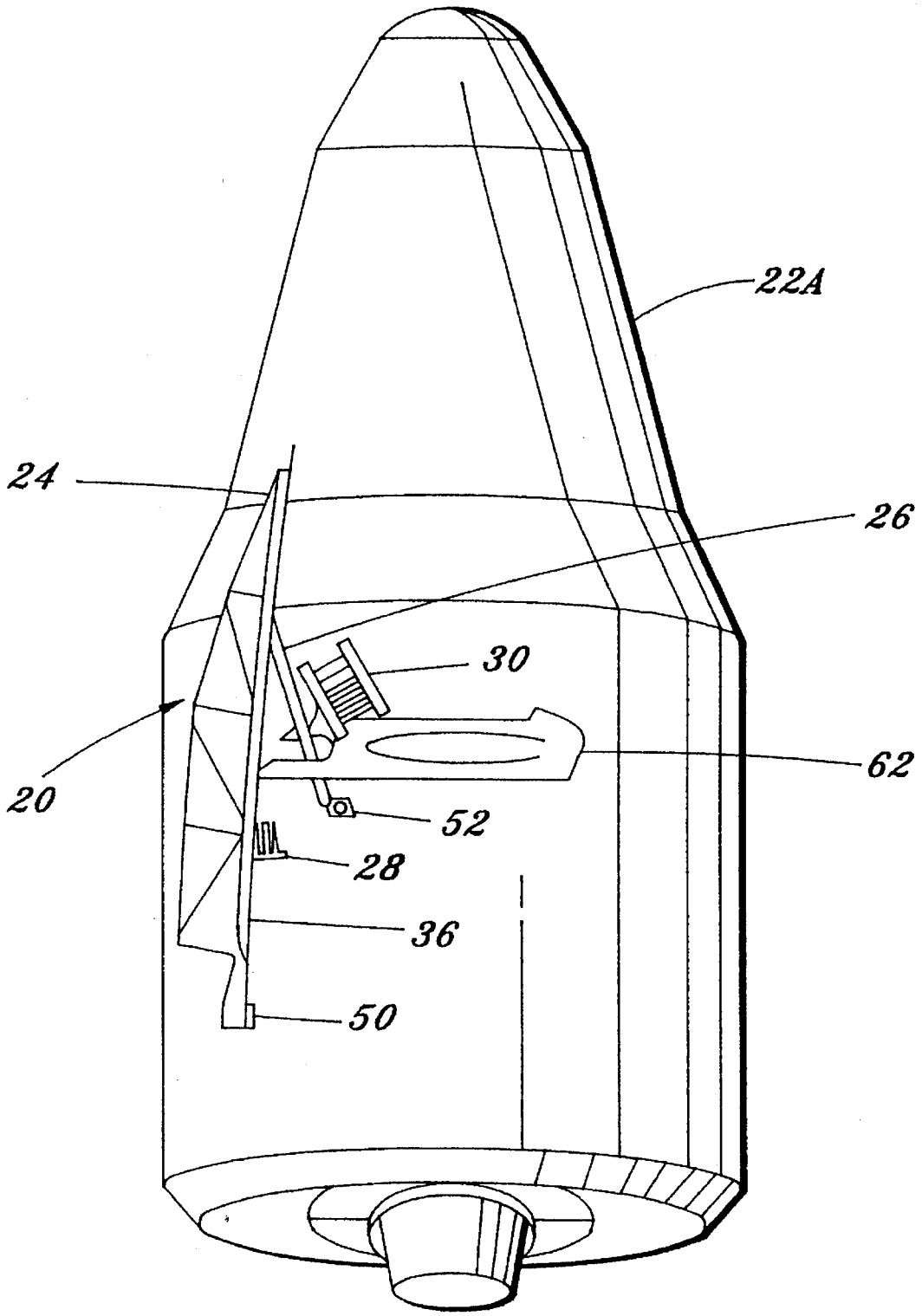
FIG. 2 shows a simplified view of an antenna of FIG. 1 folded in a stowed attitude within a shroud of a launch vehicle.
Figure 3:
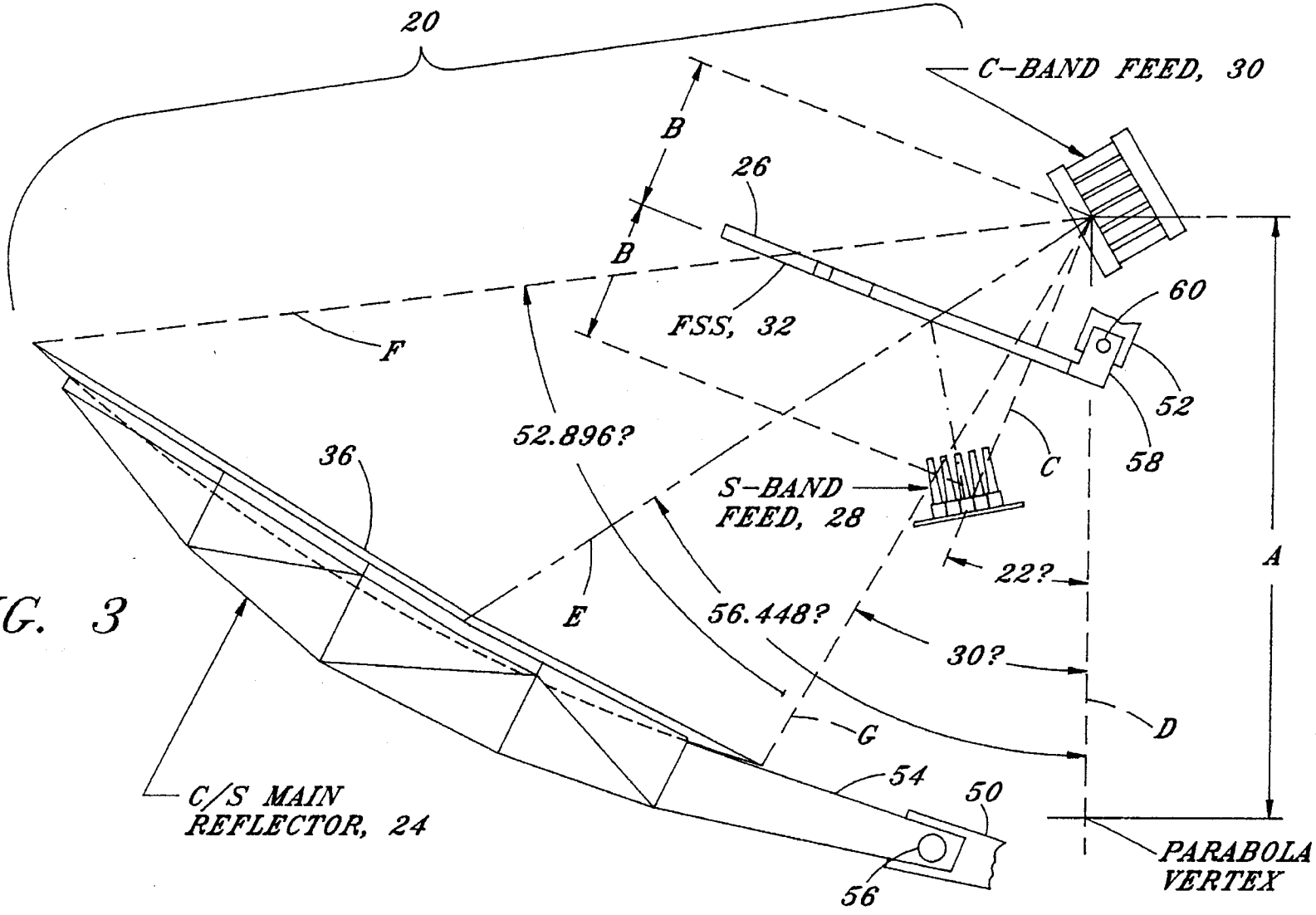
FIG. 3 shows diagrammatically spatial relationships among components of the antenna in the deployed state.

As shown in FIGS. 1–3, the stowing of the antenna 20 is accomplished by providing hinges 50 and 52, respectively, for the main reflector 24 and the subreflector 26, the hinges 50 and 52 being disposed on the satellite housing 34 (FIG. 1). The hinges 50 and 52 enable the main reflector 24 and the subreflector 26 to be pivoted relative to the housing 34 from the stowed position of FIG. 2 to the deployed position of FIG. 1. As shown in further detail in FIG. 3, a portion of the hinge 50 includes a straight arm 54 extending from the main reflector 24 to engage with a pivot 56 of the hinge 50. A portion of the hinge 52 includes a bent arm 58 extending from the subreflector 26 to engage with a pivot 60 of the hinge 52. A hold-down 62 (FIG. 2) secures the antenna 20 to the satellite 22 in the stowed condition of the antenna 20. Stowing of the antenna 20 is accomplished by first pivoting the subreflector 26 to a position adjacent the C-band feed 30 followed by a pivoting of the main reflector 24 to a position adjacent to both the S-band feed 28 and the stowed subreflector 26.

The stowing of the antenna 20 provides for such a compact configuration antenna that, if desired, a second similarly constructed antenna 64 can be provided, as shown in its deployed position in FIG. 1. It is noted that presently available communication satellites employ antennas wherein a main reflector is pivotal from a stowed position to a deployed position, and that suitable deployment devices for bringing the reflector into its desired orientation and for maintaining the desired orientation are presently available. Such devices are employed in the practice of the invention, and need not be described in detail herein for an understanding of the invention.

FIG. 3 shows spatial relationships among the antenna components upon a deploying of the antenna 20. The reflecting surface 36 of the main reflector 24 is an offset paraboloidal reflecting surface. A reference line C joins the antenna focus, at the C-band feed 30, to the virtual focal point of the antenna 20, at the S-band feed 28. A second reference line D extends from the antenna focus at the C-band feed 30 to the vertex of the paraboloidal surface of the main reflector 24. The FSS of the subreflector 26 is flat, intersects the line C, and is perpendicular to the line C. Angulation of line C relative to line D is shown in FIG. 3. Also shown is angulation of a central ray E of the C-band feed 30 relative to the line D, as well as the orientation of extreme rays F and G. The invention permits the construction of a relatively large antenna, as compared to presently available antennas, such that the distance A between the C-band feed 30 and the parabola vertex is 104 feet, and wherein the spacing 2B between the feeds 28 and 30 is 42 feet.

Figure 5:
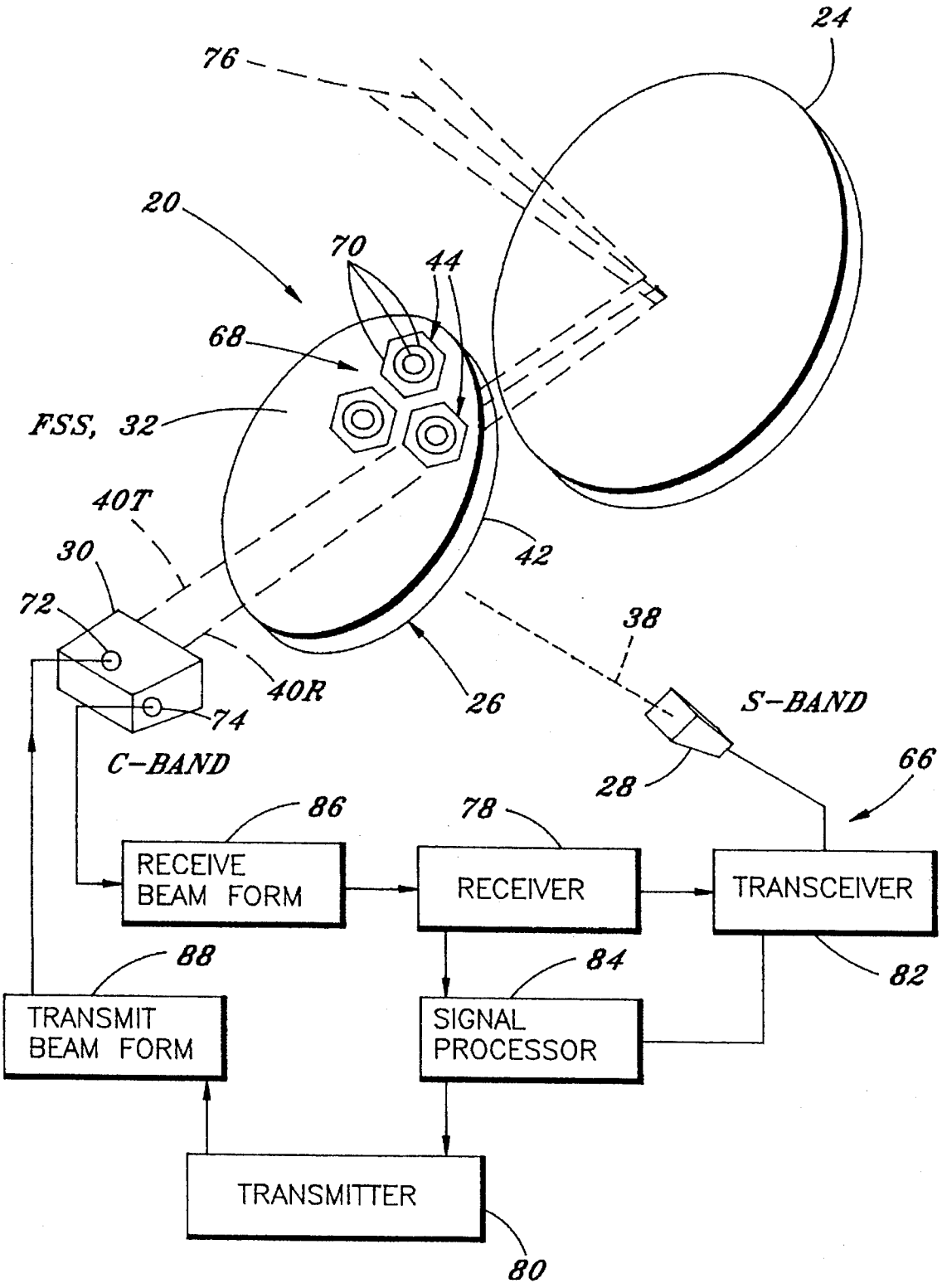
FIG. 5 is a simplified view of the antenna connected to components of a communication system indicated diagrammatically.

FIG. 5 shows further details of the antenna 20 and also, by way of example, a portion of a communication system 66 employing the antenna 20. FIG. 5 shows a portion of an array 68 of the radiating elements 44 of the FSS. Each of the radiating elements 44 comprises a nested set of annular radiators 70 of successively larger size wherein one of the radiators enclosed another of the radiators. Three radiators 70 are shown, by way of example, in each of the radiating elements 44, and wherein an outermost one of the radiators 70 in each of the radiating elements 44 is hexagonal. In accordance with a feature of the invention, the use of the outer hexagonal radiator 70 permits a closer spacing of the radiating elements 44 to obtain improved antenna performance in terms of increased bandwidth and operation of the FSS with increased beam width for each of the feeds 28 and 30. Further details in the construction of the FSS will be provided hereinafter.

In accordance with a feature of the invention, and in order to provide the feature of the two C-band signal channels, the C-band feed 30 has two orthogonal ports 72 and 74. The port 72 serves to input signals for transmission by the feed 30 in the aforementioned transmission signal channel. The port 74 serves to output signals received by the feed 30 in the aforementioned reception signal channel. Transmission is indicated by a ray 40T of radiation, and reception is indicated by a ray 40R of radiation. In accordance with the operation of the feed 30, electromagnetic waves represented by the rays 40T and 40R are circularly polarized with opposite senses of polarization. For example, the transmitted wave may have a right hand circular polarization, and the received wave may have a left hand circular polarization. The rays 40T and 40R are portrayed by long dashes, and the ray 38 from the S-band feed 28 is portrayed by short dashes. Beams of C and S band radiation produced by the antenna 20 are indicated at 76.

The communication system 66 includes a receiver 78, a transmitter 80, a transceiver 82, and a signal processor 84. The antenna 20 includes a receive beamformer 86 which connects with the receiver 78, and a transmit beamformer 88 which connects with the transmitter 80. As will be described hereinafter, the beamformers 86 and 88 are formed within the structure of the C-band feed 30. The transceiver 82 connects with the S-band feed 28. In the practice of the invention, the S-band signal channel can be used for either reception or transmission of signals and, accordingly, the transceiver 82 has been provided to enable either a transmission or a reception of microwave signals as may be desired. Connections are provided between the signal processor 84 and the transceiver 82 as well as with the receiver 78 and the transmitter 80. Generally, in satellite communications systems, one of a plurality of communication channels in one spectral band is employed for an up-link signal transmission, and another of the plurality of signal transmission bands is a separate portion of the electromagnetic spectrum is employed for the down-link transmission of signals. The system 66 provides for a generalized situation wherein the S-band signal channel may be employed for either up-link or down-link transmission and the two C-band channels are operative concurrently for both up-link or down-link transmissions.

In operation, an up-link signal from a ground station to the satellite is incident upon the antenna 20, and propagates via the C-band feed 30, including the port 74, and the receive beamformer 86, to the receiver 78. The receiver 78 applies the received signal to the signal processor 84 which, by way of example, may demodulate the signal, filter the signal, and modulate the signal onto a further carrier suitable for retransmission, thereby to transfer a signal from an up-link transmission band to a down-link transmission band for transmission back to a location on the earth. In the retransmission of the signal, the signal is outputted by the signal processor 84 to the transmitter 80 which transmits the signal via the C-band feed 30, including the transmit beamformer 88 and the port 72, to be radiated by the antenna 20 in a down-link beam. Alternatively, an up-link signal may be presented to the signal processor 84 by the transceiver 82, or a down-link signal may be transmitted from the signal processor 84 via the transceiver 82.

Figure 6:
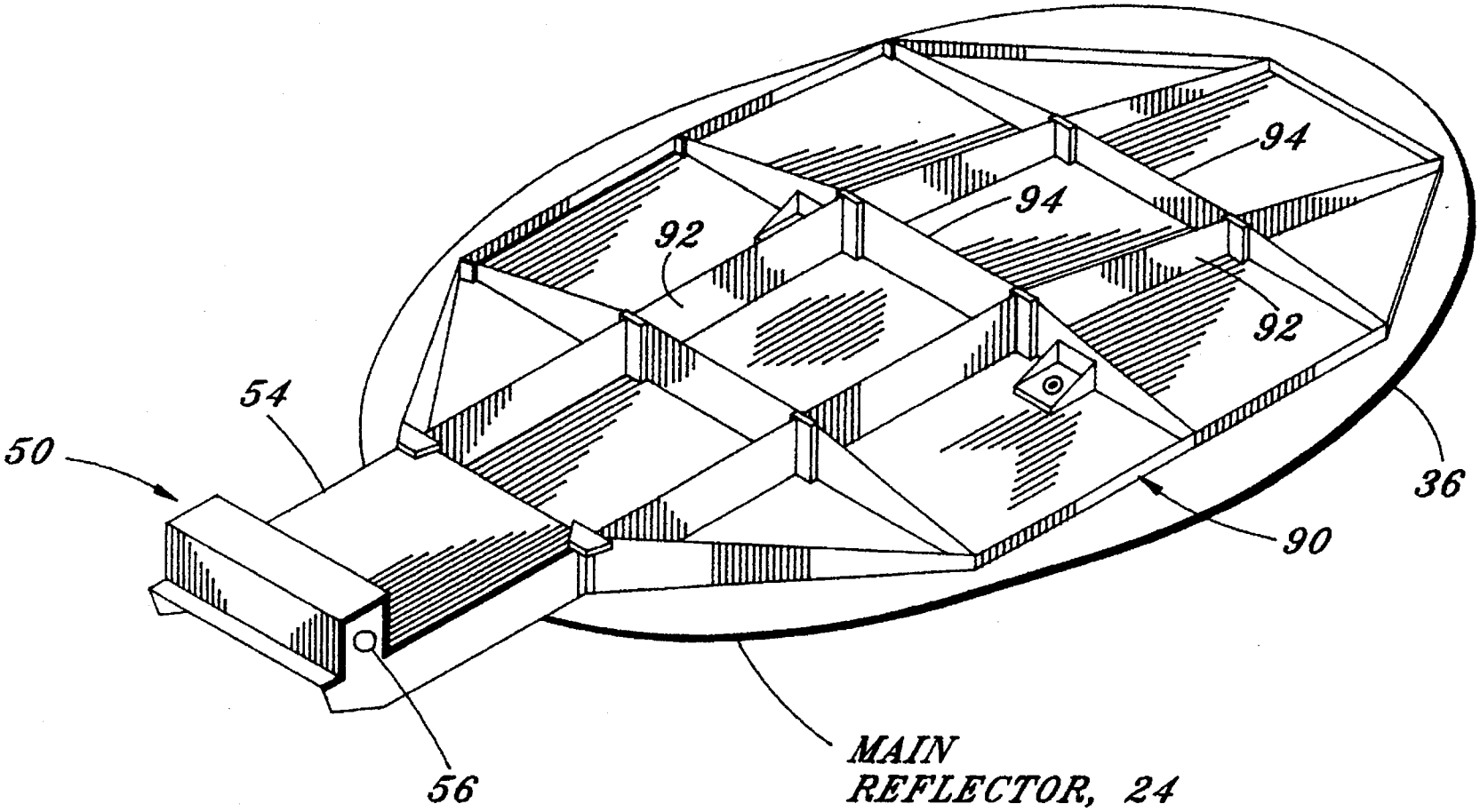
FIG. 6 is a perspective view, partly stylized, of a main reflector of the antenna showing a frame providing dimensional stability.

FIG. 6 shows further details in the construction of the main reflector 24. The reflector 24 includes a frame 90 located on a back side of the reflecting surface 36. The frame 90 has longitudinal struts 92 and transverse struts 94 to provide dimensional stability to the reflecting surface 36. The hinge 50 is shown partially in FIG. 6, the hinge 50 connecting via its arm 54 to the frame 90 to enable pivoting of the main reflector 24 about the pivot 56.

Figure 7:
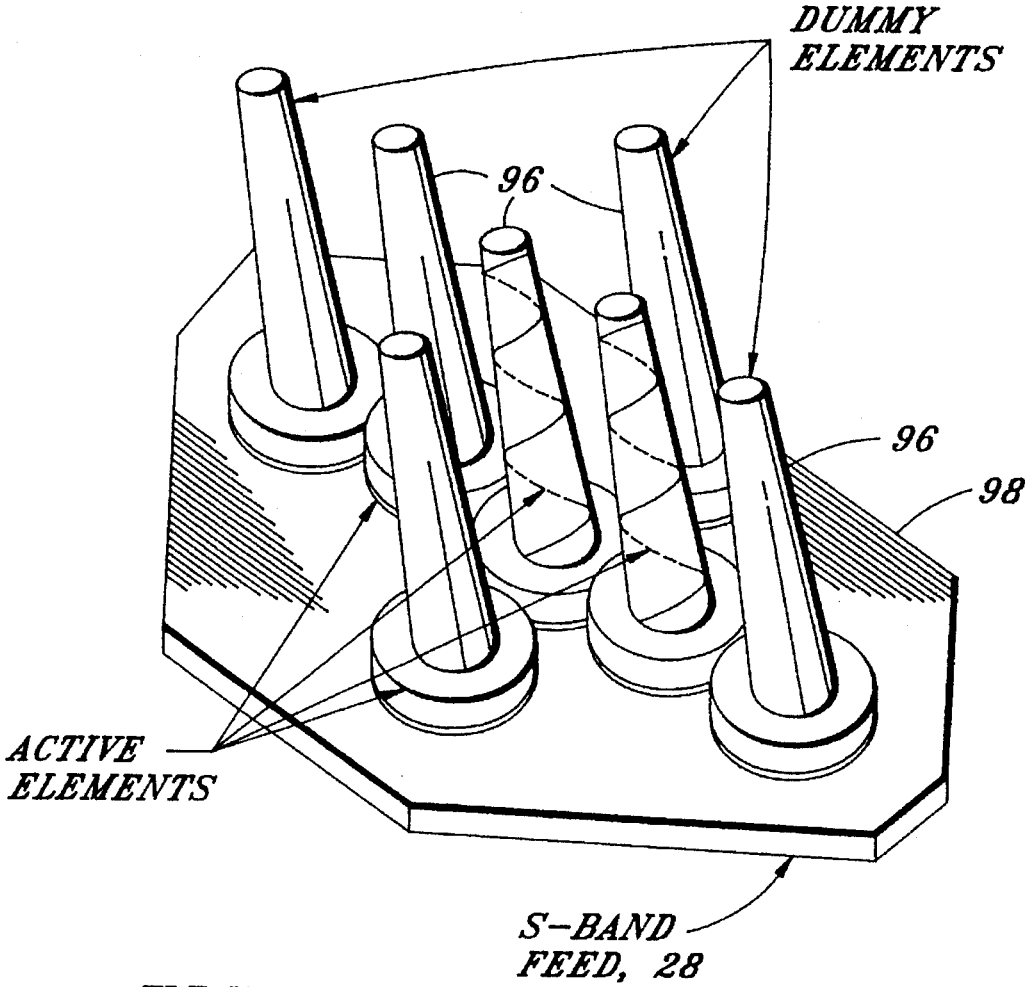
FIG. 7 is a stylized view of an S-band feed of the antenna wherein helical radiators are shown for only two of the radiating elements of an array to simplify the drawing.

FIG. 7 shows details in the construction of the S-band feed 28. The feed 28 comprises, by way of example as constructed in a preferred embodiment of the invention, seven helical radiating elements 96 supported by a base 98. To simplify the drawing, five of the radiating elements 96 are shown only in outline form. Four of the elements 96 are active, as indicated in the drawing, for producing four independent beams directed toward the earth. The remaining three of the elements 96 are dummy elements, as indicated in the drawing, for balancing mutual coupling effects of the active helical elements, thereby to avoid a squinting of the beams away from each other for improved accuracy in defining earth coverage by the respective beams. Typically, the base 98 is fabricated of an electrically conductive material, such as a metal, to serve as a ground plane for the radiating elements 96.

FIGS. 8–14 provide details in the construction of the C-band feed 30. The feed 30 comprises an array of radiators 100 which are upstanding from a supporting metallic base 102 which serves as a ground plane of the feed 30. Each of the radiators 100 comprises a straight section of waveguide 100 of square cross section, and a flared horn 106 communicating with the waveguide section 104. Each of the radiators 100 is fabricated of electroformed copper. A meander-line polarizer 108 extends across the radiating apertures of the respective horns 106. Each of the waveguide sections 104 has four sidewalls 110, and the ports 72 and 74 are located in a pair of abutting ones of the sidewalls 110 to provide for the orthogonal arrangement of feeding electromagnetic signals into and out of a radiator 100. Each of the ports 72 and 74 comprises a coaxial feed 112 having an inner conductor 114 enclosed within an outer conductor 116. Four ridges 118 are provided in each radiator 100, there being one ridge 118 extending inwardly from a central portion of each sidewall 110 to provide a quad-ridge configuration. The ridges 118 extend along each radiator 110 in a direction parallel to a longitudinal axis 120 from a back wall 122 of the waveguide section 104 to the radiating aperture 124 at the front of the horn 106. Each of the ridges 118 has a maximum depth at the back end of the radiator 100, in the vicinity of the back wall 122, and then tapers through the waveguide section 104 and within the horn 106 to a zero depth at the radiating aperture 124.

In the construction of the ports 72 and 74, the coaxial feeds 112 are located within individual ones of the ridges 118. For purposes of matching the feed 112 to the waveguide section 104, the coaxial feed 112 extends across the axis 120 into the opposite ridge 118, the amount of extension of the inner conductor 114 being adjusted to provide for the desired impedance match. The ridges 118 are operative to provide increased bandwidth to each of the radiators 100. Each of the ports 72 and 74 is capable of launching a single linearly polarized wave within the radiator 100. The linearly polarized waves are orthogonal to each other. The meanderline polarizer 108 is operative to convert one of the linearly polarized waves to right-hand circular polarization, and to convert the other of the linearly polarized waves to left-hand circular polarization in each of the radiators 100.

Figure 14:
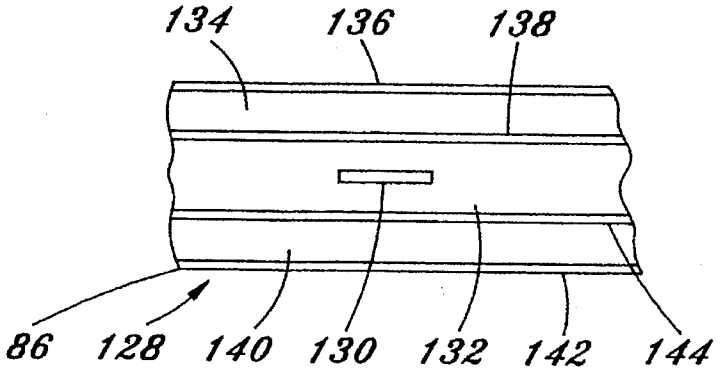
FIG. 14 shows diagrammatically a fragmentary sectional view of a barline network of either of the beamformers of FIGS. 12 and 13.
Figure 8:
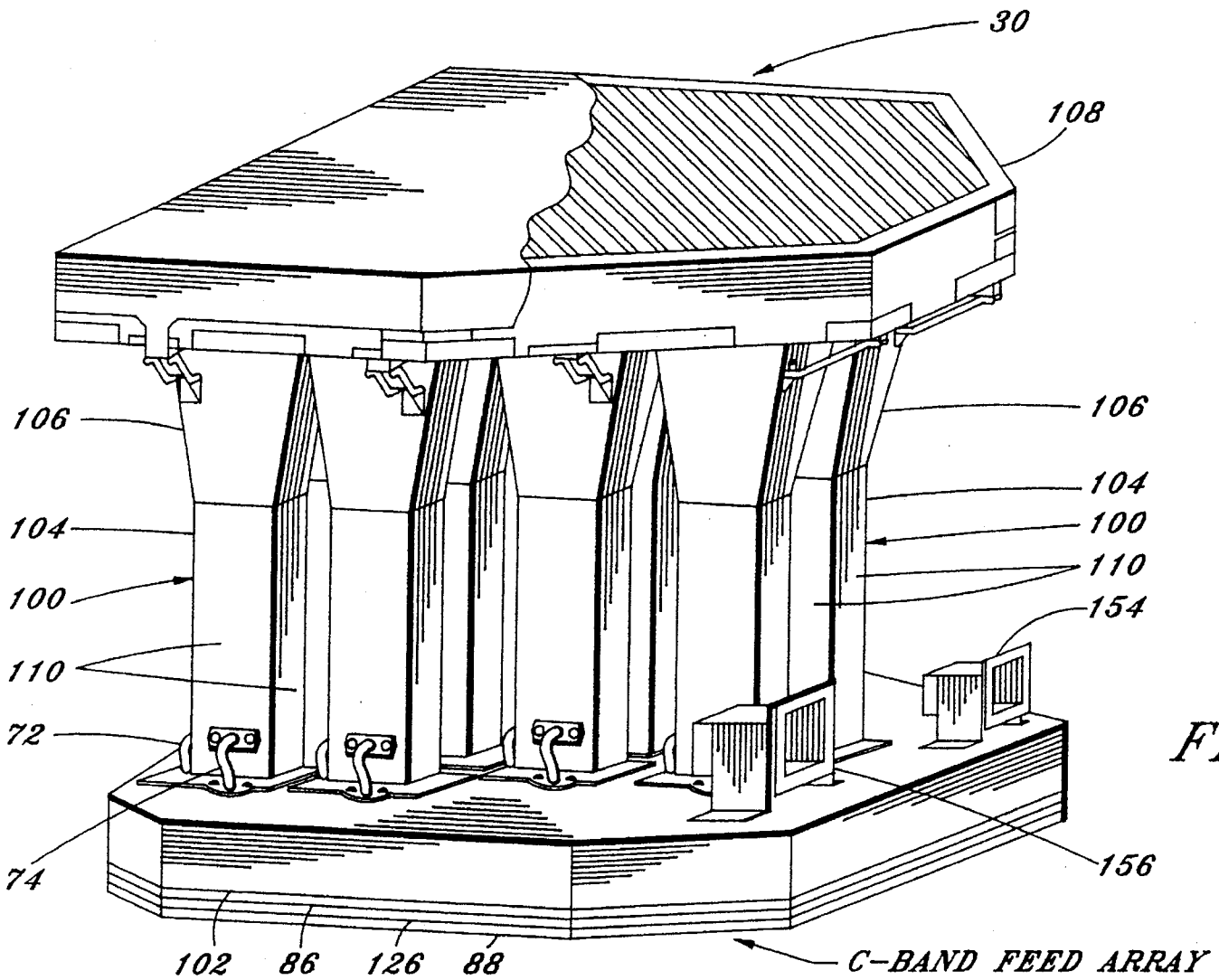
FIG. 8 is a stylized perspective view of a C-band feed of the antenna, the feed having an array of radiators.
Figure 9:
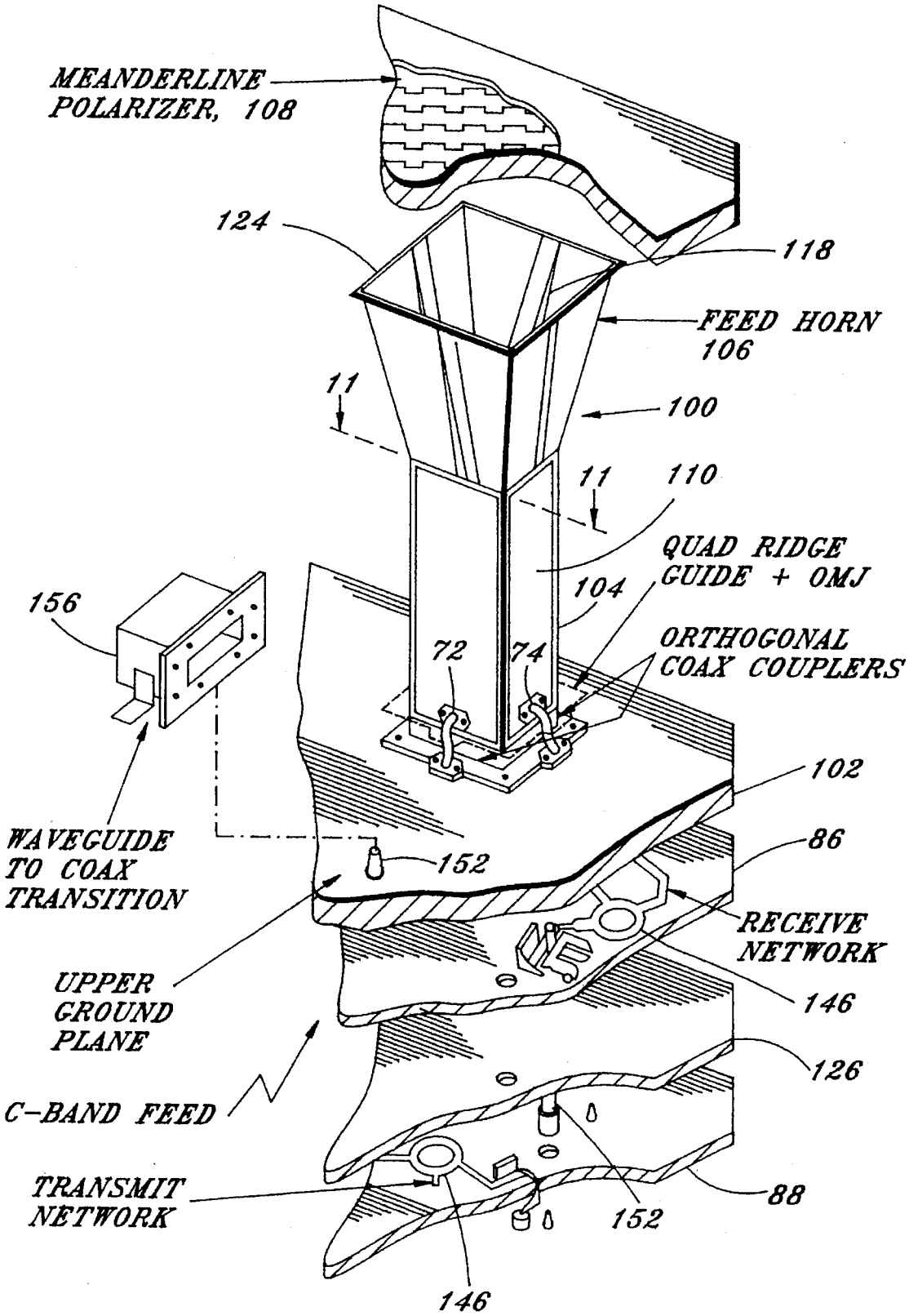
FIG. 9 is an exploded view of a radiator of FIG. 8.
Figure 10:
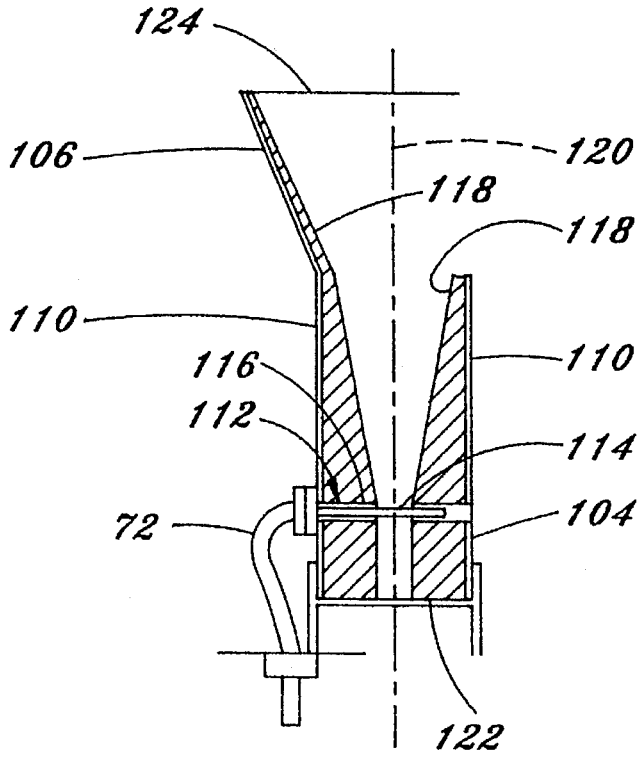
FIG. 10 is a fragmentary axial sectional view of the radiator of FIG. 9.
Figure 11:
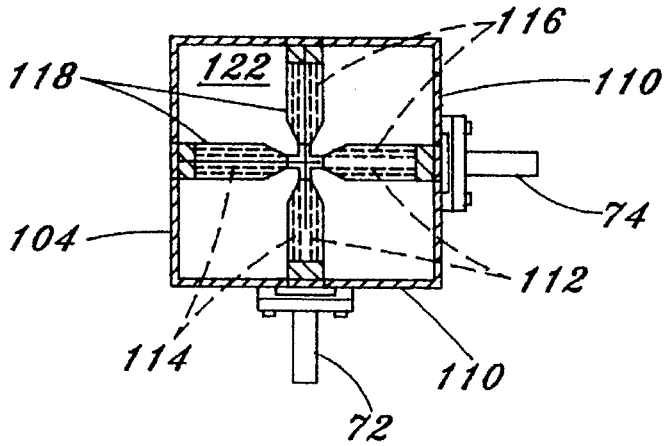
FIG. 11 is a transverse sectional view of the radiator of FIG. 9 taken along the line 11—11 in FIG. 9.

On the underside of the base 102 are disposed the receive beamformer 86 and the transmit beamformer 88 which are constructed as barline circuit networks in laminar form, the two beamformers 86 and 88 being separated by a metallic layer 126 which serves as a ground plane and isolates the circuits of the beamformers 86 and 88 from each other. A fragmentary portion 128 of the barline network of the receive beamformer 86 is shown in FIG. 14, the portion 128 comprising a barline center conductor 130 disposed within a layer 132 of honeycomb dielectric material, an upper aluminum honeycomb layer 134 sandwiched between a first face skin 136 of electrically insulating dielectric material and a second face skin 138 of electrically insulating dielectric material, and a lower aluminum honeycomb layer 140 sandwiched between a first face skin 142 of electrically insulating dielectric material and a second face skin 144 of electrically insulating dielectric material. The constructional features of the portion 128 apply also to the construction of the transmit beamformer 88 and, accordingly, no sectional view of the beamformer 88 need be provided.

Figure 12:
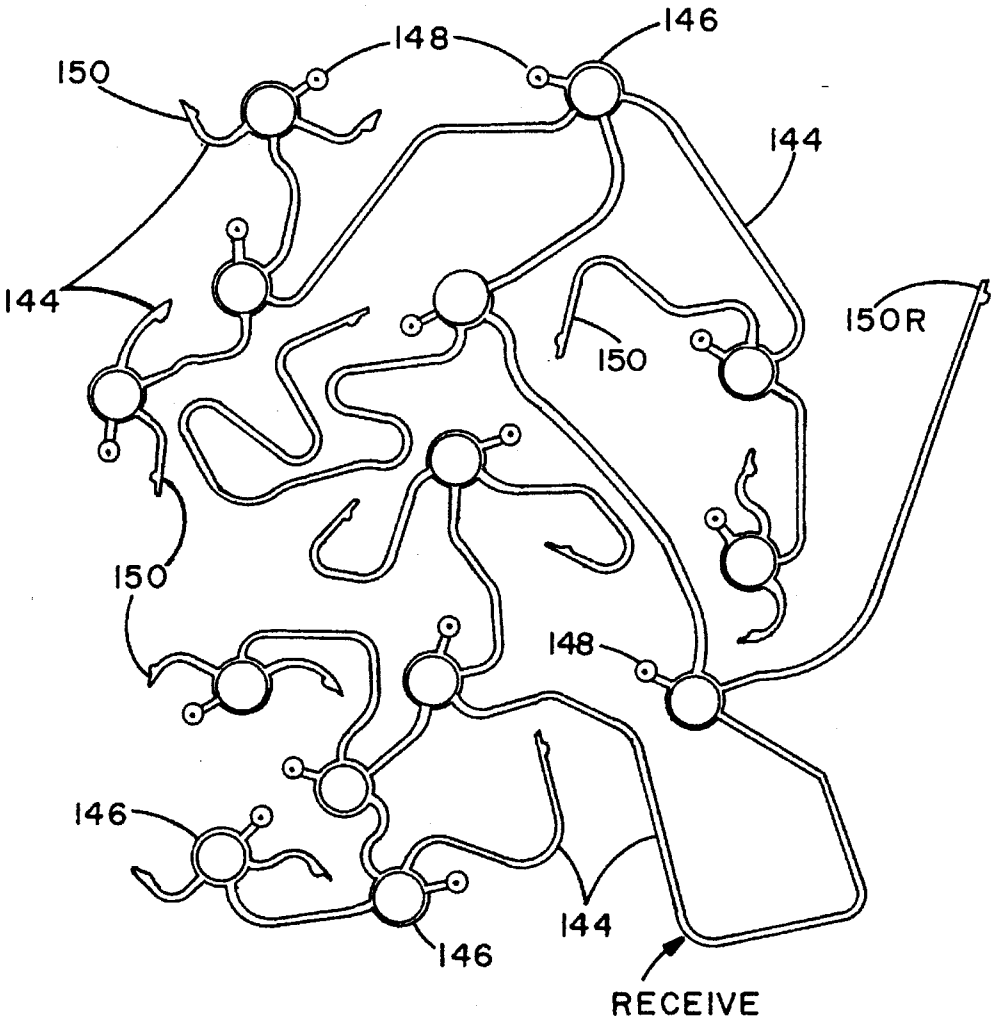
FIG. 12 is a plan view of a barline beamformer of the antenna for providing a receive beam.
Figure 13:
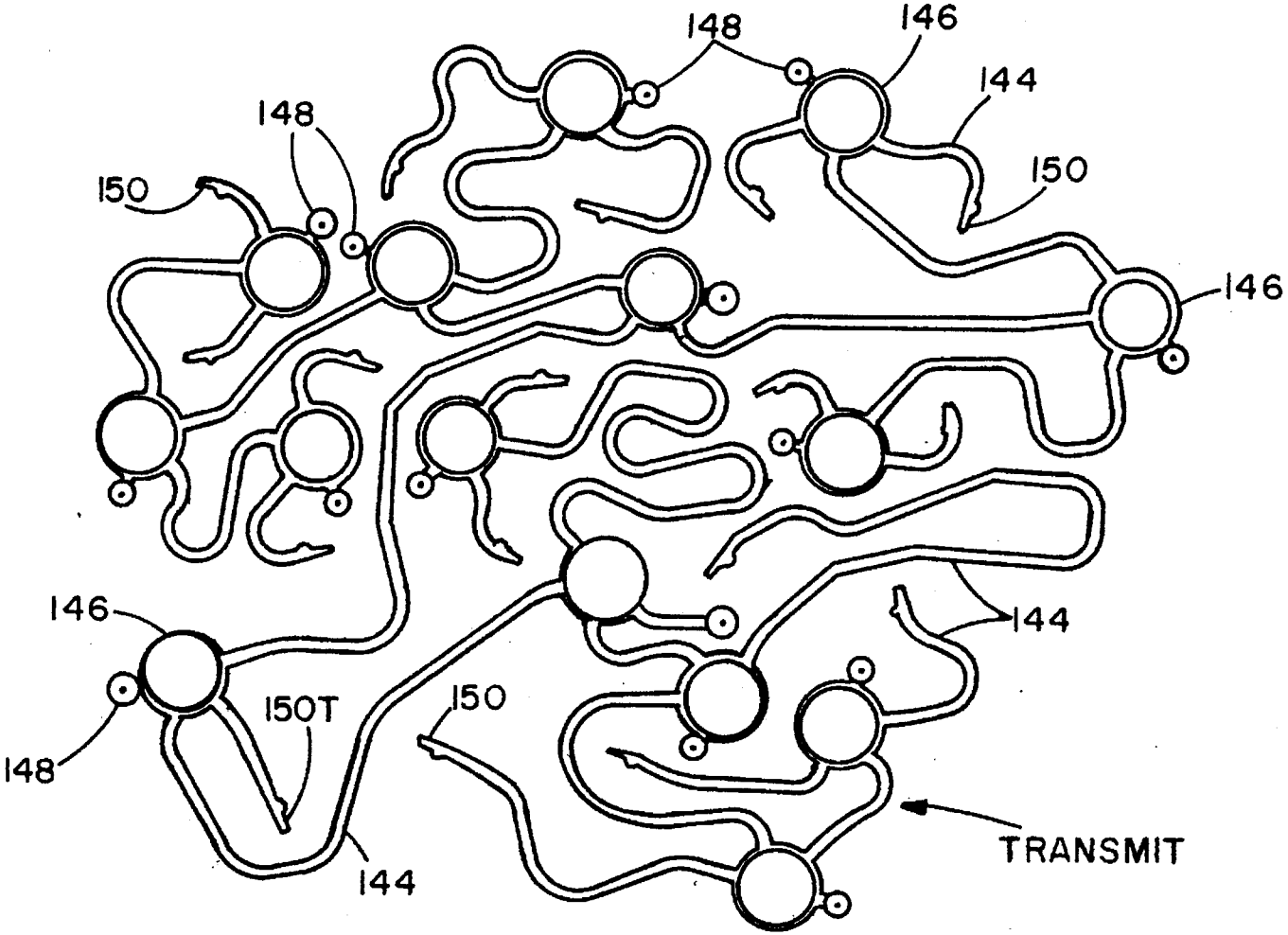
FIG. 13 is a plan view of a barline beamformer of the antenna for providing a transmit beam.

FIGS. 12 and 13 show plan views of the circuit barline networks of the receive beamformer 86 and the transmit beamformer 88, respectively. The networks of each of the beamformers 86 and 88 include barline segments 144 of specific lengths to introduce phase shifts among the radiators 100 (FIG. 8), circular power dividers 146 connected to the barline segments 144 for dividing power among the radiators 100, loads 148 connected to the barline segments 144 for matching line impedance (typically 50 ohms), and connections 150 to the port 74 (FIG. 8) in the case of the receive beamformer 86 or to the port 72 in the case of the transmit beamformer 88. Each of the connections 150 comprise a feed-through element 152, two of the feed-through elements 152 being identified in FIG. 9. The power dividers 146 can act also in reciprocal fashion so as to serve as a power combiner in the receive beamformer 86 while serving to divide power in the transmit beamformer 88. In FIG. 12, one of the connectors 150R connects with a coax-t0-waveguide transition 154 on top of the base 102 (FIG. 8) for connection to the receiver 78 of FIG. 5. In FIG. 13, one of the connectors 150T connects with a coax-t0-waveguide transition 156 on top of the base 102 (FIGS. 8 and 9) for connection to the transmitter 80 of FIG. 5.

In the operation of the receive beamformer 86, power received at the C-band feed 30 with the requisite sense of the circular polarization is converted by the meanderline polarizer 108 to a linearly polarized wave which propagates along each of the radiators 100, is extracted by the respective receive ports 74 and is applied to the connections 150 of the beamformer 86. Via the power dividers (combiners) 146, the beamformer 86 sums the signals from the respective radiators 100 with appropriate phase shift being provided by the barline segments 144 to obtain a receive beam and to output power of the receive beam to the receiver 78. The receiver has a pass band tuned to reception of the received signal while excluding the spectrum of the transmit signal. In the operation of the transmit beamformer 88, a signal applied by the transmitter 80 is divided by the power dividers 146 among the transmit ports 72 of the respective radiators 100 with appropriate phase shift being provided by the barline segments 144 for generating the transmit beam from the array of the radiators 100.

Figure 15:
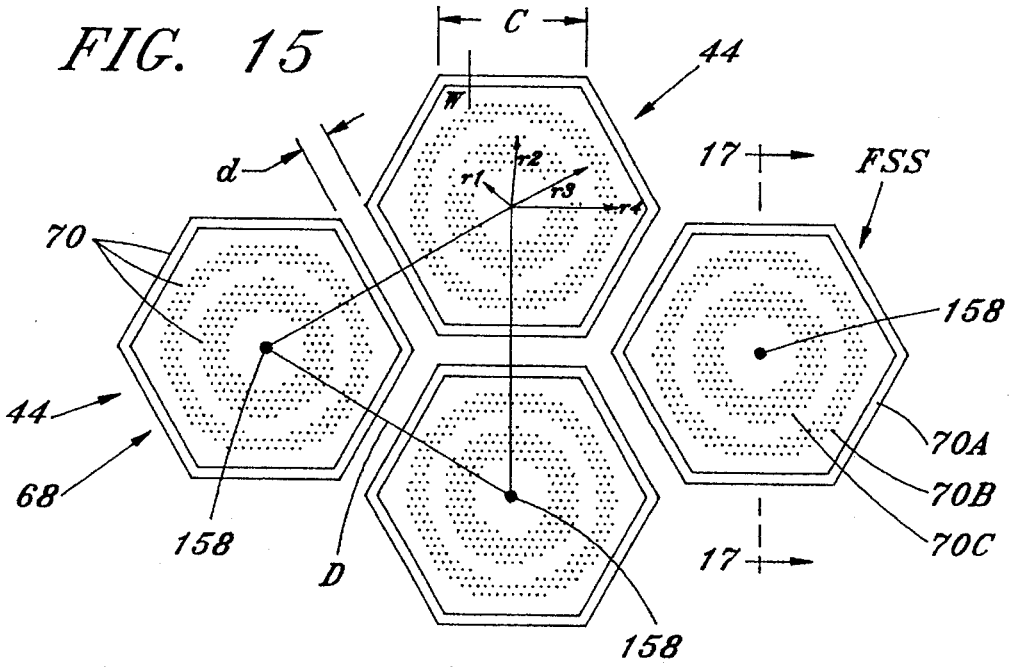
FIG. 15 is a plan view of a front surface of the FSS of the subreflector of the antenna, a supporting substrate having been deleted to simplify the drawing to show an arrangement of radiating elements of the FSS formed of electrically conductive material.
Figure 16:
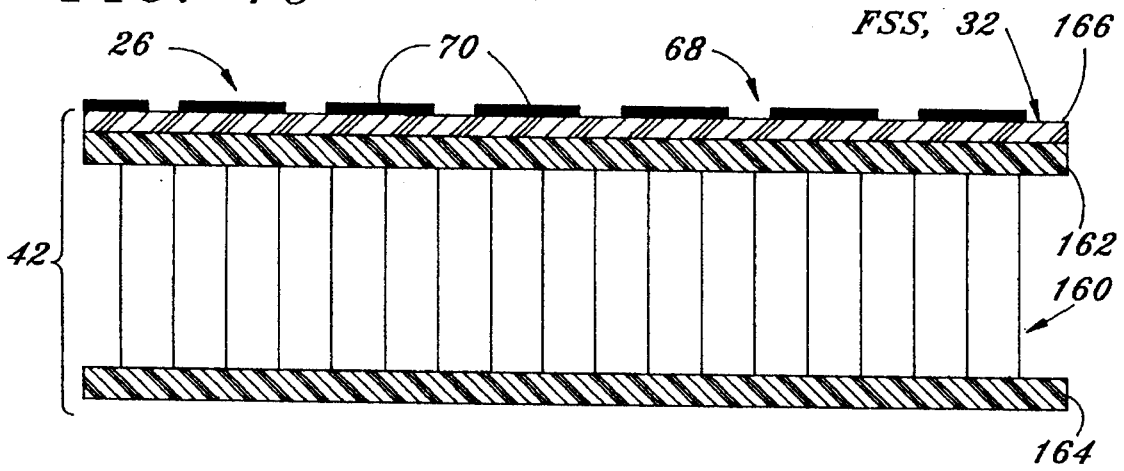
FIG. 16 is a sectional view of the FSS, the view including a substrate for supporting radiating elements on the front surface of the substrate with the radiating elements being indicated diagrammatically.
Figure 17:
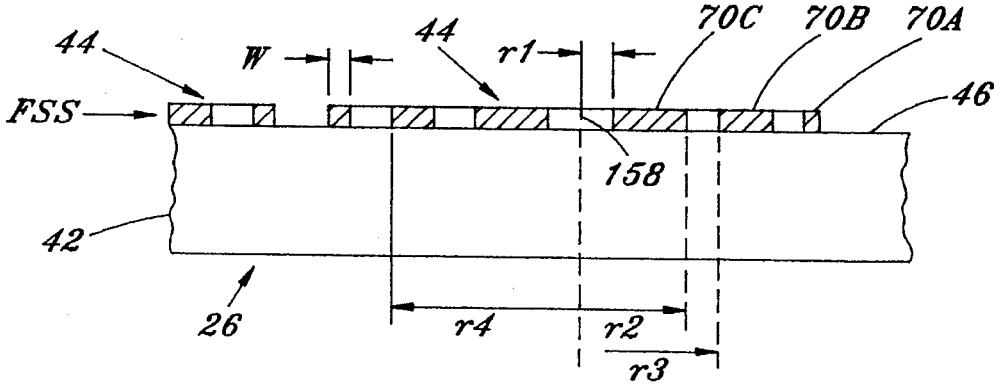
FIG. 17 is a sectional view of the FSS taken along the line 16—16 in FIG. 15 showing one set of radiating elements with the substrate being indicated diagrammatically.

FIGS. 15, 16 and 17 show details in the construction of the subreflector 26, and particularly the construction of the FSS 32. In each of the radiating elements 44 of the array 68, each of the radiators 70 is formed as a closed, generally circular path of electrically conductive material, a metal such as copper or aluminum being employed in the preferred embodiment of the invention. The substrate 42 is fabricated of dielectric materials, all of which are transparent to the C-band and the S-band electromagnetic radiation. In each radiating element 44, the outermost one of the radiators is identified as 70A, the innermost one of the radiators is identified as 70C, and the middle radiator is identified as 70B.

The spacing, D, between the centers 158 of the radiating elements 44, and the closest point of approach, d, between adjacent radiating elements 44 are indicated in FIG. 15. The inner and the outer radii $r_1$ and $r_2$ of the innermost radiator 70C are shown in FIGS. 15 and 17. Similarly, the inner and outer radii $r_3$ and $r_4$ of the middle radiator 70B are indicated also in FIGS. 15 and 17. The difference in radii, $r_2-r_1$, and the difference in radii $r_4-r_3$ provide the width of the innermost and the middle radiators 70C and 70B. The width of the outermost radiator 70A is given by W, as shown in FIG. 17. Adjacent ones of the radiating elements 44 have their centers 158 arranged at the vertices of an equilateral triangle, as shown in FIG. 15, wherein each side of the triangle is identified by the distance D. The length L of one side of the hexagon of the outermost radiator 70A in any one of the radiating elements 44 is shown also in FIG. 15.

The substrate 42 has a lightweight rigid construction which is advantageous in satellite antenna systems. The substrate 42 comprises a central honeycomb core 160 enclosed on front and back sides by layers 162 and 164 of plastic film material, such as a polycarbonate, a layer of Kevlar being used in the construction of the front and back layers 162 and 164 in the preferred embodiment of the invention. A relatively thin layer 166 of plastic material such as nylon or Upilex is secured adhesively to the front layer 162 to serve as a bed for deposition of the radiators 40, the Upilex being employed in the preferred embodiment of the invention. The honeycomb core 160 has a dielectric constant, similar to that of air, and may be formed of a material such as craft paper, such a material, Nomax being employed in a preferred embodiment of the invention.

The following dimensions are used in constructing an embodiment of the invention to operate at the foregoing spectral frequency bands. In the preferred embodiment of the invention, the radiators 70 are fabricated of copper film deposited in a layer in a range of typically 5–10 mil thickness. The minimum thickness should be equal to at least a few times the electromagnetic skin depth of the copper film. In the outermost hexagonal radiator 70A, the length L of each side is equal approximately to one-sixth wavelength of the S-band radiation, this providing a value of L=0.430 in the preferred embodiment of the invention. The width W of the radiator 70A has a value in the range of 0.01–0.02 inch, a value of 0.015 inch being employed in the preferred embodiment of the invention. This provides for a circumference of the radiator 70A approximately equal to the wavelength of the S-band radiation within the dielectric material of the substrate, thereby enabling the radiator 70A to resonate at the frequency of the S-band radiation. In similar fashion, construction of the inner annular C-band radiators 70B and 70C with mean values of circumference equal approximately to mean values of their respective bands of radiation allow these radiators to resonate at their respective frequencies.

The distance D between the centers is equal to 1.73 L which is equal to approximately one-third wavelength of the S-band radiation in the dielectric substrate, these being equal approximately to 0.770 inches in the preferred embodiment of the invention. The closest point of approach, d, is equal to 15 mils. The radii $r_1$, $r_2$, $r_3$, and $r_4$, are equal respectively to 0.70 inches, 0.265 inches, 0.275 inches, and 0.335 inches. The following dimensions are used in the construction of the substrate 42. The Kevlar layers 162 and 164 each have a thickness in the range of 10–20 mils. The honeycomb core 160 has a thickness of one inch. The Upilex layer 166 has a thickness in the range of 1–2 mils. The dielectric constant of the layers 162, 164, and 166 is in the range of approximately 2.2–2.8.

Thereby, the invention has provided for a multiple channel satellite communication antenna employing a plural channel C-band feed and a single channel S-band feed which are operative concurrently with a single main reflector by use of a subreflector constructed as an FSS.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An antenna comprising:

a main reflector, a subreflector positioned in front of said main reflector, a first feed operative at a relatively low frequency band of the electromagnetic spectrum and a second feed operative at a relatively high frequency band of the electromagnetic spectrum, said subreflector having a frequency selective surface (FSS) for reflecting radiation at the low band along a folded path between said main reflector and said first feed while permitting radiation at the high band to propagate through the FSS along a straight path between said main reflector and said second feed;

wherein said second feed comprises an array of radiators of sufficient bandwidth to accommodate a first signal channel and a second signal channel operative at a frequency different from a frequency of said first signal channel;

said antenna further comprises a first beamformer connected to said radiators of said second feed for forming a first beam within said low band, and a second beamformer connected to said radiators of said second feed for forming a second beam within said low band; and said first feed is located behind and to a side of said subreflector, and said second feed is located forward and to said side of said subreflector to provide a configuration to the antenna which is suitable for mounting on a communications satellite, said subreflector having a supporting frame with a hinge to permit a pivoting of said subreflector relative to a housing of the satellite to a stowed position alongside said second feed, and said main reflector having a supporting frame with a hinge to permit a pivoting of said main reflector relative to the housing of the satellite to a stowed position alongside said first feed and said subreflector.

2. An antenna according to claim 1 wherein, in said second feed, said radiators are sections of waveguide disposed parallel to each other and having radiating apertures located in a common plane at front ends of the waveguide sections;

said second feed further comprises a meanderline circular polarizer disposed in said common plane of said radiating apertures; and each of said first and said second beamformers comprises a planar barline network disposed behind said waveguide sections and parallel to said meanderline polarizer to provide a compact configuration of said second feed.

3. An antenna according to claim 2 wherein, in said second feed, the waveguide section of each of said radiators has a square cross section and a horn which flares outwardly toward a front end of the radiator, connection to respective ones of said first and said second beamformers is made via first and second waveguide feeds, said first and said second waveguide feeds being located in a pair of adjoining walls of each of said waveguide sections for generation of orthogonal linearly polarized waves in each of said waveguide sections; and each of said radiators has four ridges located centrally on the interior surfaces of respective ones of the walls of the waveguide section, each ridge being oriented in a longitudinal direction of said waveguide section and extending from a back end of the waveguide section to a front end of the horn with a depth of penetration into the waveguide section which varies monotonically from a maximum depth at the back end of the waveguide to a minimum depth at the front end of the horn for increasing the bandwidth of the radiator.

4. An antenna according to claim 1 wherein said first feed comprises an array of helical radiators, said first beamformer of said second feed serves for generating a transmitting beam of radiation, and said second beamformer of said second feed serves for generating a receiving beam of radiation.

5. An antenna according to claim 4 wherein, in said first feed, a first plurality of said helical radiators are operated in an active mode for generation of plural independent beams of radiation, and a second plurality of said helical radiators are operated in a dummy mode to balance mutual coupling effects of said first plurality of helical radiators.

6. An antenna according to claim 1 wherein said FSS of said subreflector comprises:

a substantially periodic array of sets of radiating elements disposed along a surface of said FSS, each of said radiating elements having a closed form wherein, in each of said sets, one of the radiating elements encloses a second of the radiating elements; and wherein an outermost one of said radiating elements has a circumference approximately equal to a wavelength of the radiation at a lower frequency of said low frequency band, said sets of radiating elements being spaced apart by a spacing equal approximately to one-half wavelength of the radiation at said lower frequency.

7. An antenna comprising:

a main reflector, a subreflector positioned in front of said main reflector, a first feed operative at a relatively low frequency band of the electromagnetic spectrum and a second feed operative at a relatively high frequency band of the electromagnetic spectrum, said subreflector having a frequency selective surface (FSS) for reflecting radiation at the low band along a folded path between said main reflector and said first feed while permitting radiation at the high band to propagate through the FSS along a straight path between said main reflector and said second feed;

wherein said second feed comprises an array of radiators of sufficient bandwidth to accommodate a first signal channel and a second signal channel operative at a frequency different from a frequency of said first signal channel;

said antenna further comprises a first beamformer connected to said radiators of said second feed for forming a first beam within said low band, and a second beamformer connected to said radiators of said second feed for forming a second beam within said low band;

said FSS of said subreflector comprises:

a substantially periodic array of sets of radiating elements disposed along a surface of said FSS, each of said radiating elements having a closed form wherein, in each of said sets, one of the radiating elements encloses a second of the radiating elements;

wherein an outermost one of said radiating elements has a circumference approximately equal to a wavelength of the radiation at a lower frequency of said low frequency band, said sets of radiating elements being spaced apart by a spacing equal approximately to one-half wavelength of the radiation at said lower frequency; and in each of said sets of radiating elements, there are three of said radiating elements, an outermost one of said radiating elements being hexagonal to reduce spacing among said sets of radiating elements for increased beam width of the antenna, an innermost one of said radiating elements being circular, and a middle one of said radiating elements being circular.

* * * * *